US006513669B2

(12) United States Patent
Ozawa et al.

(10) Patent No.: US 6,513,669 B2
(45) Date of Patent: Feb. 4, 2003

(54) BOTTLE FOR HOT FILLING USE, EQUIPPED WITH VACUUM ABSORPTION PANELS IN THE BODY PORTION

(75) Inventors: Tomoyuki Ozawa, Tokyo (JP); Tadashi Hayakawa, Matsudo (JP); Hiroaki Sugiura, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/853,596

(22) Filed: May 14, 2001

(65) Prior Publication Data

US 2001/0054597 A1 Dec. 27, 2001

(30) Foreign Application Priority Data

May 17, 2000 (JP) ..... 2000-145769

(51) Int. Cl.[7] ..... B65D 90/02
(52) U.S. Cl. ..... 215/381; 215/282; 220/669
(58) Field of Search ..... 215/381, 379, 215/382, 383, 384; 220/666, 669, 670–673, 676

(56) References Cited

U.S. PATENT DOCUMENTS

| | | | | | |
|---|---|---|---|---|---|
| D294,463 | S | * | 3/1988 | Lang | D9/349 |
| D390,114 | S | * | 2/1998 | Young | D9/520 |
| 6,044,997 | A | * | 4/2000 | Ogg | 215/381 |
| D423,935 | S | * | 5/2000 | Frazer | D9/520 |
| D428,338 | S | * | 7/2000 | Lizuka et al. | D9/424 |
| D433,946 | S | * | 11/2000 | Rollend et al. | D9/538 |
| D451,033 | S | * | 11/2001 | Lizuka | D9/516 |
| 2001/0035392 | A1 | * | 11/2001 | Ota et al. | |

* cited by examiner

*Primary Examiner*—Lee Young
*Assistant Examiner*—Lien Ngo
(74) *Attorney, Agent, or Firm*—Oliff & Berridge, PLC

(57) ABSTRACT

A PET bottle having structurally improved vacuum absorption panels in the bottle portion so as to increase the panels' resistance to the constricting force of the shrink label, to secure the force of restitution for the panels, and thereby to allow the liquid level in the bottle to lower when the cap is opened. Vacuum absorption panels comprising multiple, flat and variable surfaces, recessed from the plane of each corresponding main body wall; multiple, horizontal and grooved ribs, and having respectively a curved bottom with the middle portion of this bottom being slightly uplifted, and with each rib being placed under a variable surface in an alternately disposed manner.

1 Claim, 5 Drawing Sheets

PRIOR ART

PRIOR ART

BOTTLE FOR HOT FILLING USE, EQUIPPED WITH VACUUM ABSORPTION PANELS IN THE BODY PORTION

TECHNICAL FIELD

This invention relates to a bottle for hot filling use, and more particularly to a bottle equipped with vacuum absorption panels in the bodies of the bottle that can be covered with a full shrink label.

BACKGROUND OF THE INVENTION

Coloring PET bottles in green or other colors is practiced so as to protect the bottle content from UV rays. Since, however, the use of coloring agents is not preferable for the reutilization of PET, there is a demand for colorless PET bottles.

Thus, there has been a proposal to use a shrink label having a UV-cut effect. A problem has arisen here. If a full shrink label is wrapped around a prior-art bottle, the tightening force of the label inhibits the vacuum absorption panels of a conventional bottle to recover to their original position. When such a bottle is opened, the liquid surface does not drop from its level before the bottle opening.

Now referring to FIG. 6, which shows an example of a prior-art bottle, B is a colorless, transparent bottle blow-molded in the biaxial orientation by using a PET resin. The bottle comprises neck, shoulder and body having a square cross-section, and bottom. A vacuum absorption panel (b) is disposed in each body wall (a) of the upper and lower bodies.

As shown in FIGS. 6 and 7, the vacuum absorption panel (b) comprises a gutter (c) running along the four sides of the square panel and connecting with the body wall; and four slopes (d) gathering together in the central area and surrounded by the gutter (c)

When pressure inside the bottle is reduced, the gutter (c) and four slopes (d) are deformed with the connection line between the vacuum absorption panel (b) and the body wall (a) working as the support. This deformation of the gutter (c) and four slopes (d) gives the vacuum absorption action to the panel.

If bottles are wrapped with a shrink label up to the bottleneck after the content has been cooled, then the body walls (a) are constricted laterally by the label's tightening force. If this happens, there will be further deformation of the vacuum absorption panels (b), which have already been deformed by the reduced pressure.

Therefore, the problem is that, when the cap is opened at room temperature, the liquid level does not lower, but instead, liquid splashes out of the neck.

The full shrink label having the UV cut effect had likewise such a problem that this label could not be utilized together with prior-art bottles.

SUMMARY OF THE INVENTION

The object of this invention is to provide a PET bottle having structurally improved vacuum absorption panels in the body portion so as to increase the panels' resistance to the constricting force of the shrink label, to secure the force of restitution for the panels, and thereby to allow the liquid level in the bottle to lower when the cap is opened.

This invention is characterized in that each vacuum absorption panel of the bottle for hot filling use has a configuration comprising multiple, flat and variable surfaces, which somewhat stand back from the plane of the corresponding body wall; and multiple, horizontal and grooved ribs having respectively a curved bottom with the middle portion of the bottom being slightly uplifted, and with each rib being placed under a variable surface in an alternately disposed manner.

The bottle according to this invention is characterized in that a full shrink label is fitted to the bottle over the area from the shoulder down to the lower end of the body, and that the full shrink label has a UV cut effect to protect the bottle content from UV rays.

DETAILED DESCRIPTION OF THE INVENTION

Figure 1:
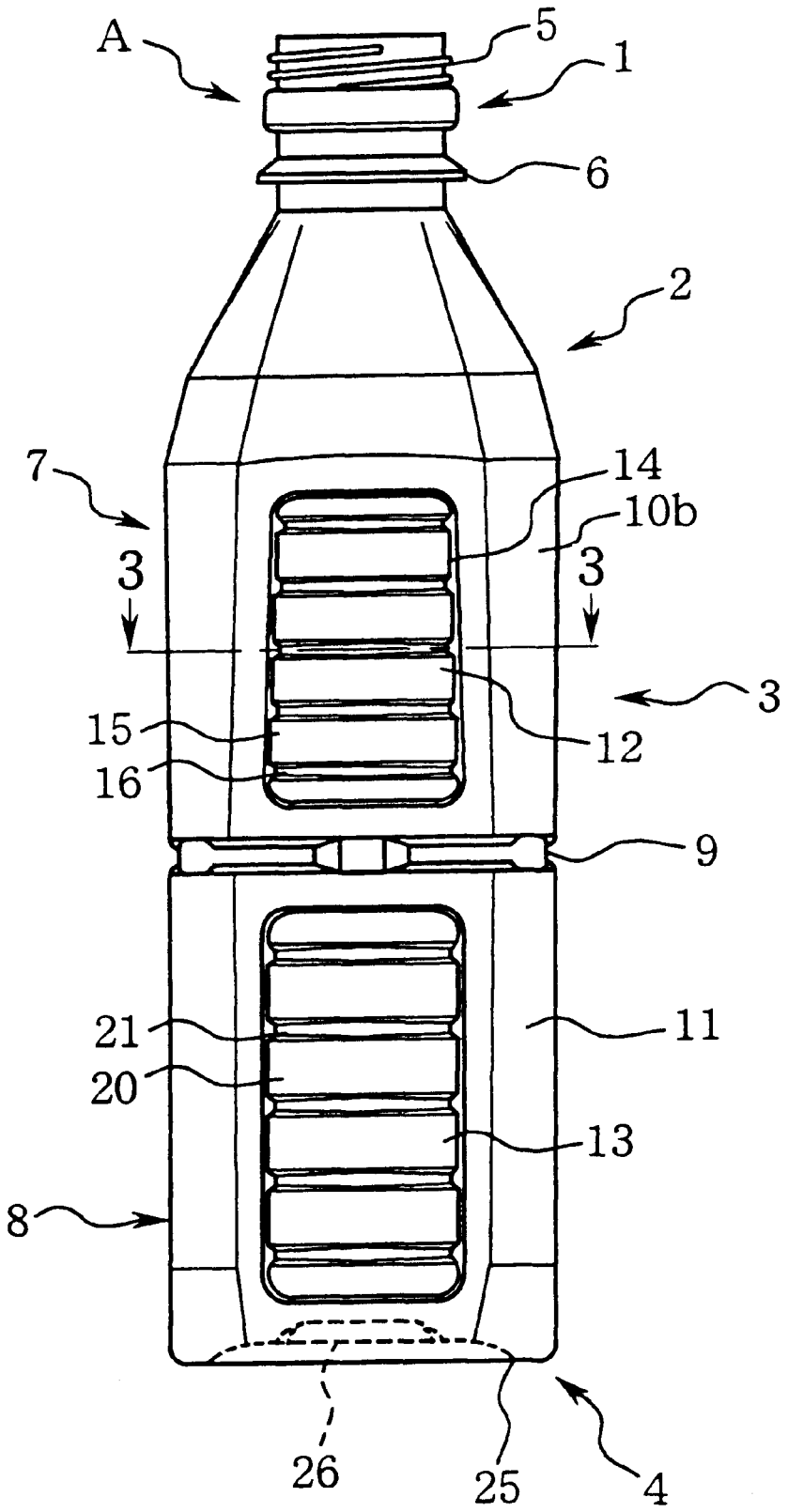
FIG. 1 is a front view of the bottle according to this invention.

This invention is further described by reffering now to the drawings. As shown in FIG. 1, the bottle A comprises neck 1, shoulder 2, body 3, and bottom 4. The bottle is blow-molded in the biaxial orientation by utilizing PET as the raw material.

On the circumference of the neck 1, there is a screw thread 5 disposed in a coil. The bottleneck is also provided with a neck ring 6 at a position below the thread 5.

The shoulder 2 and the body 3 have a roughly square shape in their cross-section, with corners being cut out. At the upper end, the shoulder 2 connects to the round neck 1.

The body 3 comprises an upper body 7 and a lower body 8, and a horizontal groove 9 is disposed between the upper and lower bodies.

Figure 2:
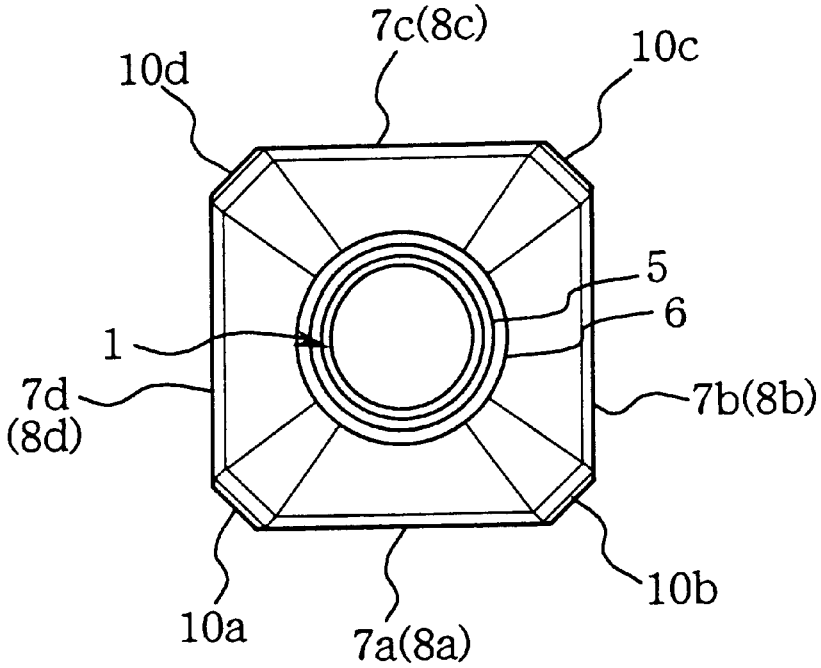
FIG. 2 is a plan view of the bottle according to this invention.
Figure 3:
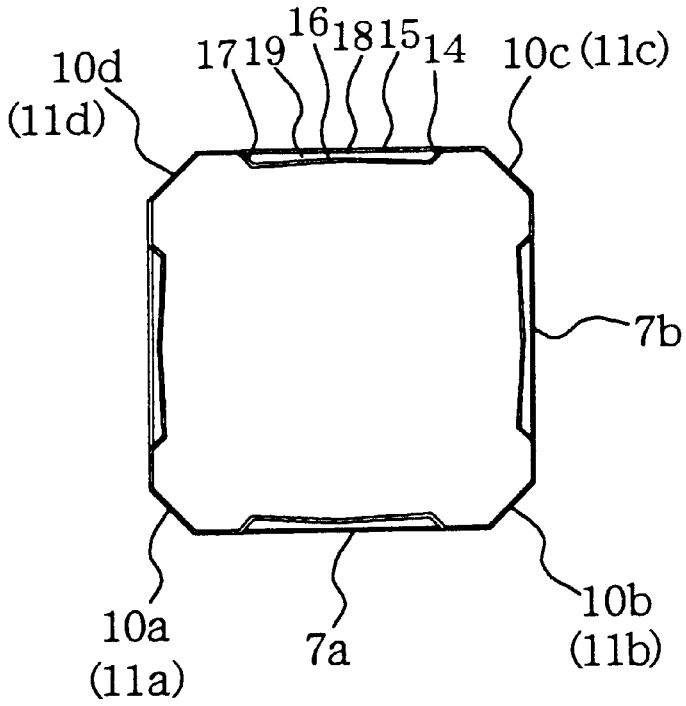
FIG. 3 is a cross-sectional view taken from line A—A of FIG. 1.

As shown in FIGS. 2 and 3, the upper and lower bodies 7 and 8 are provided with four main walls 7*a*, 7*b*, 7*c*, and 7*d*, as well as 8*a*, 8*b*, 8*c*, and 8*d*; and with straight corner walls 10*a*, 10*b*, 10*c*, and 10*d*, as well as 11*a*, 11*b*, 11*c*, and 11*d*, with each corner wall being cut out into a somewhat inclined and tapered surface. The vacuum absorption panels 12 and 13 are disposed in all four main walls 7(*a, b, c, d*) and 8(*a, b, c, d*), respectively, of the upper and lower bodies 7 and 8.

Figure 4A:
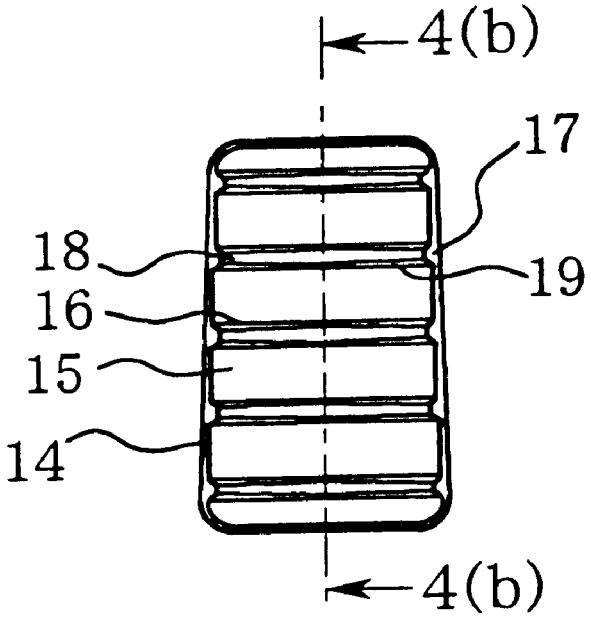
FIG. 4 is an explanatory diagram of a vacuum absorption panel of this invention, wherein (a) is a front view and (b) is a cross-sectional view taken from line A—A of (a).
Figure 4B:
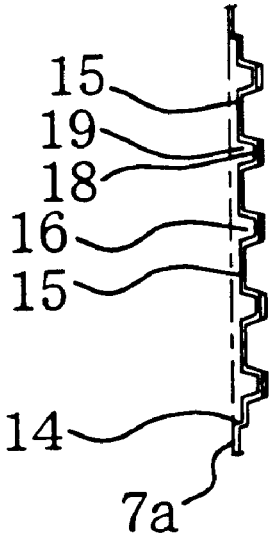

As shown in FIGS. 3 and 4, the upper vacuum absorption panel is disposed in a position setting back for a certain distance from the plane of the main wall 7(*a–d*). The vacuum absorption panel is surrounded with a narrow slope 14. Within this slope 14, the panel 12 comprises variable surfaces 15, which stand back from the plane of the main wall 7(*a-d*), and horizontal grooved ribs 16, which are placed alternately with the variable surfaces at certain intervals from top to bottom.

The variable surface 15 is a flat plane nearly parallel to the main wall 7(*a-d*). The horizontal grooved rib 16 is further recessed from the variable surface 15, and comprises side slopes 17, which are disposed on both the right and left sides and on the same plane as the slope 14; a curved groove bottom 18, with the middle portion of the bottom being slightly uplifted; and banks 19 running along the upper and lower sides of the rib 16.

As shown in FIG. 1, the lower vacuum absorption panel 13 comprises the variable surfaces 20 and the horizontal grooved ribs 21 similar to those of the upper panel 12. The peripheral outline of the lower panel 13 is similar in shape to the upper panel 12, but is somewhat enlarged in its size.

The bottom 4 comprises a ring slope 25 rising from the periphery of the bottom and a saucer-like dome 26 provided, as well known, with multiple ribs that are disposed radially.

The blow-molded bottle is filled up with a thermally sterilized liquid, and then the bottle is capped before it is cooled.

Then, a full shrink label is wrapped around the bottle to cover the bottle up to the upper end of the shoulder. For UV cut purpose, use is made of a full shrink label in which a UV-absorbing agent has been blended.

The vacuum absorption panels 12 and 13 are further described for their action and effect observed and achieved when the pressure is reduced with cooling and when the shrink label is wrapped around the bottle.

Figure 5:
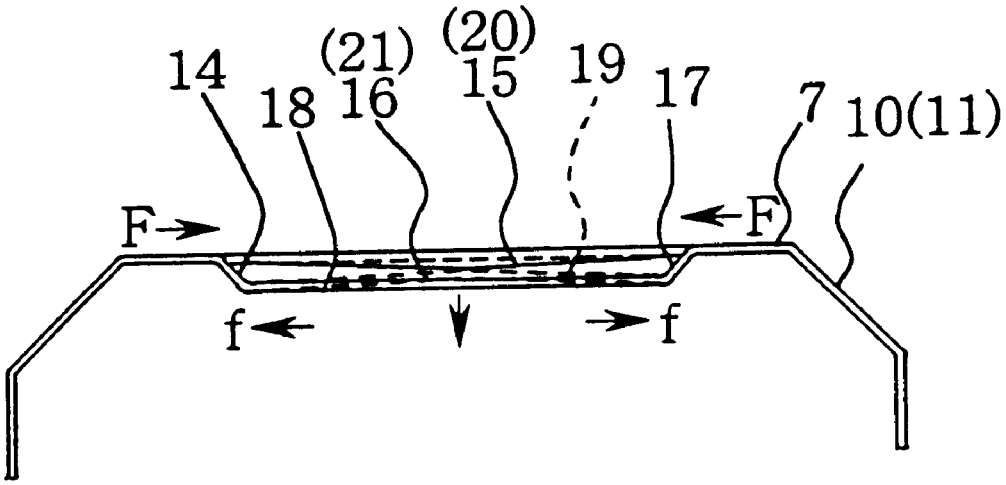
FIG. 5 is an explanatory diagram of a shrink label wrapped around the bottle.
Figure 6:
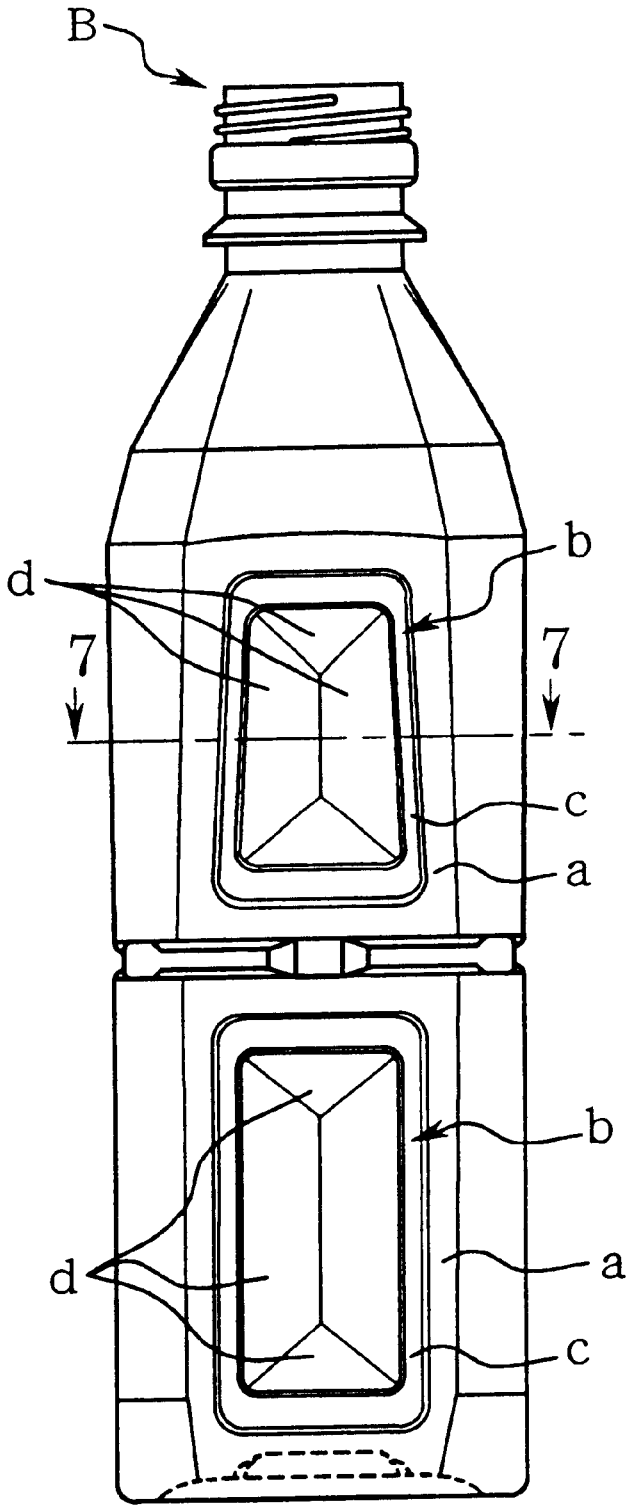
FIG. 6 is a front view of a conventional bottle.
Figure 7:
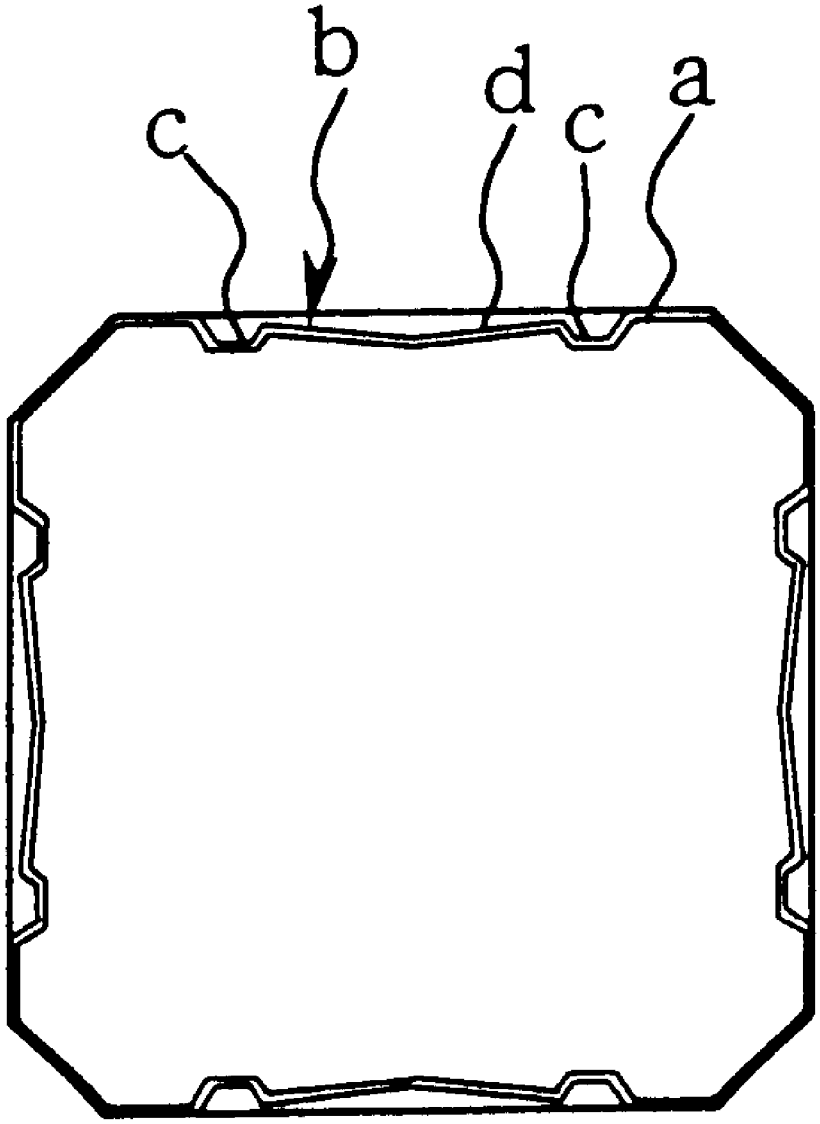
FIG. 7 is a cross-sectional view taken from line A—A of FIG. 6.

When the bottle of this invention is cooled after it has been filled up with a liquid, the variable surfaces 15 and 20 of the vacuum absorption panels 12 and 13 are drawn inward and deformed with the decrease in inner pressure, as shown in FIG. 5. At that time, the peripheral slope 14 serves as the support. Before this deformation, the horizontal grooved ribs 16 and 21 had a somewhat uplifted portion in the middle of the rib bottom, but now the rib bottom is flat and straight so that it is possible for the vacuum absorption panels 12 and 13 to absorb the reduced pressure.

When a full shrink label is wrapped around the bottle, the shrink-wrap causes a tightening force (F) to work on the straight corner walls 10 and 11. As a result, the main walls 7(*a–d*) and 8(*a–d*) are laterally constricted.

In the meantime, the horizontal grooved ribs 16 and 21 are given a reaction force (f) against the tightening force F of the shrink label because of the toughness of the rib banks 19 and because each groove bottom 18 of the horizontal grooved ribs 16 and 21 turns straight.

This reaction force (f) prevents the variable surfaces 15 and 20 from being further deformed, and works to maintain the shape of the vacuum absorption panels 12 and 20.

When the cap is opened, the force of restitution acts on the variable surfaces 15 and 20 and on the horizontal grooved ribs 16 and 21. The variable surfaces 15 and 20, which have been drawn inward and deformed, go back to original flat surfaces. Concurrently, the horizontal grooved ribs 16 and 21 return to the condition in which they have been placed before the pressure decrease. As a result of these action and effect, the liquid level drops with the cap opening.

The action and effect of the vacuum absorption panels are further described from a test.

In this test, a bottle A of this invention and a conventional bottle B, each having a 500-ml volume, were filled up with a liquid heated to 89° C., and after the cap was tightened and the bottles were cooled, a full shrink label was wrapped around each bottle. When the temperature dropped to 22° C., the length from neck top to the liquid surface (the liquid level) and the headspace volume were compared between two bottles.

The above two factors were also compared between bottles wrapped with a full shrink label and the bottles without the label. The test results are as shown in Table 1.

TABLE 1

| Test item | | Sample | |
|---|---|---|---|
| | | Bottle A | Bottle B |
| Liquid level right after the cap was opened at 22° C., mm. | Labeled | 38.78 | 30.48 |
| | Label removed | 44.56 | 42.49 |
| | Δh | 5.78 | 12.01 |
| Headspace volume right after the cap was opened at 22° C., ml. | Labeled | 18.61 | 11.71 |
| | Label removed | 26.68 | 23.33 |
| | ΔH · S | 8.07 | 11.62 |

As found from the above results of a comparison between the labeled and label-removed bottle B, the liquid level and the headspace volume for the labeled bottle B decreased by 28.3% and 49.8%, respectively, as compared to the label-removed bottle B.

This indicates that the bottle B has a lower force of restitution because the vacuum absorption panels are constricted by the shrink-wrap of the label.

On the other hand, from a comparison between the labeled and label-removed bottles A, it was found that the liquid level and the headspace volume for the labeled bottle A decreased only by 13.0% and 30.2%, respectively, as compared to the label-removed bottle A. Thus, after vacuum absorption, the panels' restitutive action is found to remain less decreased.

This indicates that when the vacuum absorption panels are provided with horizontal grooved ribs, the panels are protected from deformation caused by the shrinkage of the full shrink label and that after absorption of a reduced pressure, the restitutive action of the panels can be secured.

The foregoing preferred embodiment of this invention was described in the case where PET bottles were used. In addition to PET, another utilizable resin is PEN (polyethylene naphthalate). Since PEN itself cuts UV rays, there is no need to pay attention as to whether or not a shrink label has the UV cut effect. Thus, in such a case, the full shrink label is wrapped mainly because of bottle decoration, but there can be obtained similar action and effect that are comparable to those of the PET bottle in the preferred embodiment of this invention.

In the above-described preferred embodiment, the body portion has a square shape, although four corners of the bottle are cut out. The bottle can also be triangular or pentagonal in its shape, provided that each corner should be cut out or blunted.

In the above-described preferred embodiment, a full shrink label is wrapped around the bottle after a thermally sterilized liquid has been filled up and the bottles have been cooled. Similar action and effect can also be obtained when the full shrink label is first wrapped around the vacant bottle, and then the bottle is filled up with a thermally sterilized liquid.

However, because vacuum absorption panels are provided with multiple, horizontal and grooved ribs, these ribs give the panels a force of reaction against the tightening force of the shrink label so that the panels can maintain the deformed state within a normal level when the pressure inside the bottle is reduced. This, in turn, makes it possible for the vacuum absorption panels to restore their original state easily, and thereby to make the liquid level descend, when the cap is opened,

What is claimed is:

1. A bottle for hot filling use, comprising:

main body walls; and vacuum absorption panels in the bottle, each of the vacuum absorption panels corresponding to one of the main body walls, each of said vacuum absorption panels including:

multiple, flat and variable surfaces, recessed from a plane of each corresponding main body wall; and multiple, horizontal and grooved ribs having respectively a bottom with a middle portion of said bottom being slightly uplifted, and with each rib disposed between the variable surfaces in an alternately disposed manner.

* * * * *